US008771109B2

(12) United States Patent
Desender

(10) Patent No.: US 8,771,109 B2
(45) Date of Patent: Jul. 8, 2014

(54) TABLE TENNIS APPARATUS

(76) Inventor: David J. Desender, Calgary (CA)

( * ) Notice: Subject to any disclaimer, the term of this patent is extended or adjusted under 35 U.S.C. 154(b) by 246 days.

(21) Appl. No.: 13/083,039

(22) Filed: Apr. 8, 2011

(65) Prior Publication Data

US 2012/0258823 A1 Oct. 11, 2012

(51) Int. Cl.
*A63B 67/04* (2006.01)

(52) U.S. Cl.
USPC ..... 473/496; 473/490

(58) Field of Classification Search
USPC ..... 473/490, 496; 108/1, 5
See application file for complete search history.

(56) References Cited

U.S. PATENT DOCUMENTS

| | | | | | |
|---|---|---|---|---|---|
| 1,689,626 | A | * | 10/1928 | Gallowitz | 108/8 |
| 1,898,666 | A | * | 2/1933 | Isaacson | 108/6 |
| 1,907,780 | A | * | 5/1933 | Froelich | 108/6 |
| 2,128,046 | A | * | 8/1938 | Hell | 248/181.1 |
| 2,313,701 | A | * | 3/1943 | White | 473/475 |
| 2,710,051 | A | * | 6/1955 | Greenberg | 108/6 |
| 2,935,118 | A | * | 5/1960 | Meilleur | 297/124 |
| D260,154 | S | * | 8/1981 | Dremel | D21/799.2 |
| 4,772,018 | A | * | 9/1988 | Inniger | 473/475 |
| 4,943,056 | A | | 7/1990 | Bowers | |
| 5,178,385 | A | * | 1/1993 | Barbador | 473/475 |
| 5,354,051 | A | | 10/1994 | Fehrenbach et al. | |
| 5,460,365 | A | * | 10/1995 | Payne | 473/494 |
| 5,470,057 | A | | 11/1995 | Bodford, Jr. | |
| 5,575,471 | A | * | 11/1996 | Robinson et al. | 473/475 |
| 5,655,979 | A | | 8/1997 | Blue | |
| D409,698 | S | * | 5/1999 | Beckham et al. | D21/799.2 |
| D410,266 | S | * | 5/1999 | Beckham et al. | D21/799.2 |
| 5,935,024 | A | * | 8/1999 | Lao | 473/434 |
| 6,729,982 | B1 | | 5/2004 | Appelbaum et al. | |
| 7,841,958 | B2 | * | 11/2010 | Fleming et al. | 473/496 |
| 8,216,094 | B2 | * | 7/2012 | Seme | 473/496 |
| 2005/0159251 | A1 | | 7/2005 | Houston et al. | |
| 2012/0258823 | A1 | * | 10/2012 | Desender | 473/496 |

* cited by examiner

*Primary Examiner* — Raleigh W Chiu
(74) *Attorney, Agent, or Firm* — Vidas, Arrett & Steinkraus, P.A.

(57) ABSTRACT

A rebounding panel apparatus for adding a further playable surface for a table tennis table. The rebounding panel apparatus comprises a support member, having table attachment means thereon to permit attachment to a side edge of the table tennis table. A substantially flat rebounding panel is provided, pivotably coupled to an upper portion of the support member. The support member when attached to the table is adapted to support said rebounding panel member above a plane in which said table lies, and the pivotable coupling means is adapted to permit adjustable inclination of the rebounding panel, preferably about each of the pitch, yaw, and skew axis. A table tennis apparatus, comprising a table and a pair of rebounding panel apparatus as described above, is further disclosed.

24 Claims, 15 Drawing Sheets

TABLE TENNIS APPARATUS

FIELD OF THE INVENTION

The invention relates to table tennis equipment, and more particularly to an improved rebounding panel for a table tennis table to increase playing surface, which rebounding panel advantageously is pivotably adjustable to allow a player to select a desired rebounding angle commensurate with his/her skill level and personal preferences.

BACKGROUND OF THE INVENTION AND DESCRIPTION OF THE PRIOR ART

Various modifications and accessories to table tennis tables and nets have been proposed over the years with a view to increasing the challenge of playing the game of table tennis, increasing the ease of playing table tennis, allowing for only one player to play, or to allow making use of different or further skill sets.

For example, U.S. Pat. No. 6,729,982 entitled "Table Tennis Table, Conversion Kit, and Associated Method" teaches a pair of rigid auxiliary panels having mounting elements for mounting the auxiliary panels to respective side edges of a table tennis table, so that the auxiliary panels each have a first orientation extending substantially perpendicularly relative to the horizontal main table panel, and an alternate second orientation substantially coplanar with the mail table panel to thereby extend the playing surface of the main panel thereby increasing the playing surface area for playing table tennis.

U.S. Pat. No. 5,470,057 entitled "Paddle Game", teaches the providing of an elongate deflector member for resting on a table top, such as a table tennis table. The deflector has a generally triangular configuration when viewed in cross-section, and has two opposing angular playing surfaces which extend toward each other in intersecting planes to form an apex. A thin game board is removably positioned on and co-operates with the deflectors so that the game board extends generally vertically above the apex of the deflector. The thin game board, supported by the angular playing surfaces, has a target such as one or more openings therein for use by the players when returning or serving a ball to the opposing player.

U.S. Pat. No. 5,655,979 entitled "Table Tennis Style Game with Basketball Backboards, Hoops, Nets, and Foam Ball" teaches a table tennis style apparatus, comprising a normal table tennis table, further having a pair of mutually-opposite basket-ball style backboards disposed on mutually-opposite side edges of such table, with a net extending perpendicularly therebetween. The basketball-style backboards are detachable from the side edges of the table.

U.S. Pat. No. 5,460,365 entitled "Table Tennis Side Rebound Panel" teaches a pair of side rebound panels for mounting at respectively opposite parallel side edges of a table tennis table. Each of the rebound panels is supported by laterally stabilizing tubular triangular inclined struts. A table tennis net is adapted to extend intermediate each of the rebound panels. The rebound panels when in playing position remain in fixed vertical orientation in a plane parallel to the longitudinal axis of the table tennis table.

To like effect, U.S. Pat. No. 5,178,385 entitled "Portable Game Apparatus", teaches a table tennis table having vertical side panels similar to U.S. Pat. No. 5,460,365, save that instead of using triangular struts to stabilize the panels when mounted on opposite side edges of the table, the panels are instead each provided with along their base with protruding elements with may be inserted into corresponding apertures provided in the table tennis table, so as to thereby secure and stabilize the vertical side (rebounder) panels, which in playing position remain in fixed vertical orientation.

U.S. Pat. No. 5,935,024 entitled "Table tennis Rebound Board" teaches a vertical back board for mounting along one of the short parallel edges of a table tennis table, which has a front face with a plurality of undulations therein. The rebound board, when vertically mounted to the table tennis table, allows a player to bounce the table tennis ball off the rebound board and thereby have the table tennis ball returned to him or her, but due to the undulations in the board the direction of return is constantly varying thereby providing challenge and interest for the single player.

U.S. Pat. No. 4,943,056 entitled "Table tennis Table Accessory Device" teaches a rotatable ball rebound backboard unit (12), and a plurality of pivoted sideboard units suspended from a moveable support unit, whereby the backboard unit (12) and the sideboard units (13) may be disposed at selected angles and orientations relative to one another and to the table tennis table. Each of the sideboard units (13) comprise a generally elongate trapezoidal rebound board member (40) suspended from an elongated L-shaped rod member (41), wherein the downwardly depending leg (42) of the rod member (41) is dimensioned to be rotatably received in the recess (23) formed in the support arms (22), such that the sideboard units (13) may be rotated both towards and away from one another as well as the backboard unit (12). Significantly, due to the pairing of the sideboard units (13) with the backboard unit, such device can only adapt a table tennis table to be played by one player.

U.S. Pat. No. 5,354,051 entitled "Ball Return Practice Device" likewise teaches a rebound board which may be mounted on a net which bisects a ball court. The rebound board has a textured surface subdivided into squares.

US Publication 2005/0159251 entitled "Ball Return Device" teaches a pair of triangular ramp members which may be placed in juxtaposed position but on opposite sides of a ball net, such as a table tennis net. End brackets (32)(34) may be connected to opposite ends of each of the two ramp members (22) (24) to further facilitate direction of a ball.

U.S. Design Pat. 410,266 entitled "Table Tennis Game Table Top with Bankboards" teaches an ornamental design for a table tennis game table top with deflecting side panels. The side panels are located on opposite side edges of the game table top, and extend vertically upward therefrom. No teaching is provided as to whether the inclination of such "bankboards" may be variably inclined or positioned.

U.S. Pat. No. 5,575,471 entitled "Table Tennis Apparatus" is one of the more relevant prior art publications in respect of the invention hereinafter disclosed and claimed in this application. In this regard U.S. '471 teaches a table tennis apparatus having a horizontal playing surface, further having a pair of vertically upright rebounding panels mounted centrally and at respectively opposite side edges of the playing surface. The rebounding panels each possess a plurality of variously inclined surfaces. In a preferred embodiment, the rebounding panels are slideably attached to the table to provide for slidable lateral adjustment of the panels horizontally towards or away from the side edges of the table tennis table. Disadvantageously, however, the rebounding panels are fixedly positioned in a vertically upright position, and while there is disclosed means to adjust and vary the lateral distance separating each rebounding panel and the side edge of the table tennis table and thus adjust the lateral separation distance between the rebounding panels, there is no disclosure or teaching of any feature which would allow the inclination of the rebounding panel to be adjusted, nor the height of such rebounding panel to be adjusted, to be able to account for player preferences and varying skill levels and assist players in being best able to use the rebounding panels and without making their use so challenging that such panels are not used.

In addition, due to the plurality of inclined surfaces provided on each rebounding panel in US regard to the rebounding panels, each of a different inclination, it is extremely difficult for a serving player to be able to consistently be able to hit a ball of the rebounding panel and cause it to land on the table tennis table on the opposing players's side. Moreover, and likewise it is extremely difficult for a returning player to be able to ever return a ball which is banked off a rebounding panel.

As a result, use of prior art rebounding panels frequently results in immediate stoppages in table tennis play, thereby reducing player satisfaction.

In view of the foregoing shortcomings of the prior art, and in particular U.S. Pat. No. 5,575,471, in failing to provide for a satisfactory means for increasing table tennis playable surface area without resulting in reduced player satisfaction, a real need exists to improve or modify the rebounding panels of U.S. Pat. No. 5,575,471 to make it easier for table tennis players to be able to use rebound panels in table tennis games.

SUMMARY OF THE INVENTION

In order to provide certain features and advantages over the prior art table tennis apparatus, in a broad aspect of the present invention the present invention provides for a table tennis apparatus which possesses at least one rebounding panel, and preferably two rebounding panels, whose inclination (and not simply lateral separation from an edge of a table tennis table) as well as in a preferred embodiment height, may be independently variably adjustable to suit player preferences so as to maximize a player's ability to successfully use rebounding panels in a table tennis match.

More specifically, in one broad aspect of the table tennis apparatus of the present invention such invention provides for a rebounding panel apparatus comprising inter alia a support member having attachment means thereon to permit attachment to a side edge of the table tennis table. At least one substantially flat rebounding panel member is further provided, whose inclination may be variably adjusted.

In a preferred embodiment, the feature of variably adjustment of the angle of inclination of the rebounding panel is provided by pivotably coupling such rebounding panel to an upper portion of the support member, by means of a resiliently-flexible gooseneck member, or a ball and socket arrangement. Other means of providing pirovable coupling to allow for variably adjusting an angle of inclination of such rebounding panels will now occur to persons of skill in the art.

The support member when attached to the table tennis table along a side edge thereof proximate a midpoint thereof supports the rebounding panel member above the planar surface of the table tennis table. The pivotable coupling means, in one embodiment, pivotably couples the rebounding panel to the support member. The pivotable coupling means is preferably resiliently flexible coiled metallic cable, but may be a universal joint or ball and socket coupling, both of which allow for maximum freedom of movement, and permit adjustable inclination of the rebounding panel, preferably about each of the pitch, yaw, and skew axis, so as to thereby provide as many degrees of freedom as possible in allowing a player to select a desired angle of inclination. In the embodiment of the ball and socket, a set screw having a wing nut may be provided to allow for retention of a desired angle of inclination.

The selected angle of inclination of one or more rebounding panels may be subject to any rules of play which may be agreed to or stipulated between players, which rules may vary between players, and from time to time and from country to country wherever rebounding panels are used. The rebounding panels of the present invention, having variably-adjustable inclination in a preferred embodiment of all of pitch, yaw, and skew angular rotations, may thus advantageously be adapted and used regardless as to what rules may be stipulated with respect to allowable angles of inclination and positioning of rebounding panels, due to their maximum freedom of movement.

In a preferred embodiment of the rebounding panel apparatus of the present invention, such apparatus comprises:

(i) a support member, comprising an 'L'-shaped member having a horizontal leg portion and a vertical leg portion, having at an end of said horizontal leg portion farthest from of said vertical leg portion attachment means to permit fixation of said 'L'-shaped member to a side edge of a table tennis table proximate a midpoint of said table;

(ii) a rebounding panel member; and (iii) pivotable coupling means for pivotably coupling said rebounding panel to said vertical leg portion.

In an embodiment wherein the pivotable coupling is provided by a ball and socket, the support means of the table tennis apparatus of the present invention further comprises height adjustment means on said support means for permitting adjustment of an average height of said rebounding panel above said plane in which said table lies. In a preferred embodiment, such height adjustment means takes the form of having the vertical leg portion of said 'L'-shaped member slidably extendable to thereby permit sliding extension or contraction of said vertical leg so as to permit slidable adjustment of an average height of said rebounding panel above said plane in which said table lies.

In a further embodiment, again where a ball and socket means of pivotable coupling is employed, the lateral separation of the rebounding panel member from the side edge of the table tennis table is further adjustable. In this embodiment the support means further comprises lateral adjustment means to permit variable lateral positioning of said rebounding panel from a side edge of said table. In a preferred embodiment incorporating such feature, the horizontal leg portion of said 'L'-shaped member is slidably extendable or retractable so as to permit extension or contraction of said horizontal leg portion so as to permit variable lateral positioning of said rebounding panel from a side edge of said table.

In a further preferred embodiment, the rebounding panel apparatus of the present invention further provides support for the table tennis net.

Accordingly, in such embodiment, the support means further comprises table tennis net support means to support and suspend one end of a table tennis net so as to allow positioning of said table tennis net in a vertical position proximate a mid-section of said table tennis table.

In a further broad aspect of the present invention a table tennis apparatus for playing table tennis is provided. Such apparatus, in a broad aspect, comprises:

(i) a table having a substantially planar playing surface, further having support means to support said playing surface in a horizontal position;

(ii) a pair of rebounding panel apparatus for adding a further playable surface for a table tennis table, each of said rebounding panel apparatus comprising:

(a) a support member, having table attachment means to permit attachment of said support member to a side edge of a table tennis table proximate a midpoint of said table;

(b) a rebounding panel member; and (c) pivotable coupling means on said support member for pivotably coupling said rebounding panel member to said support member;

wherein said support member when attached to said table is adapted to support said rebounding panel member above a plane in which said table lies; and wherein said pivotable coupling means is adapted to permit adjustable inclination of said rebounding panel.

In a further refinement, hook or loop type fasteners may be adhesively applied to the rebounding surface of the rebounding panels, to allow selectable additional rebounding panels, of varying areas depending on player preference or pre-agreed rules, to be detachably secured. In such manner players may easily vary, as desired, the rebounding surface area of the rebounding panels, by simply detaching one size panel of a first given area, and detachably securing using the hook and loop type fasteners (eg VELCRO™[1]).

[1]Trademark of Velcro Industries B.V., of the Netherlands, for hook and loop type fasteners.

BRIEF DESCRIPTION OF THE DRAWINGS

Further advantages and permutations and combinations of the invention will now appear from the above and from the following detailed description of the various particular embodiments of the invention taken together with the accompanying drawings, each of which are intended to be non-limiting, in which.

DETAILED DESCRIPTION OF PREFERRED EMBODIMENTS

FIG. 1 (Prior Art)

Figure 1:
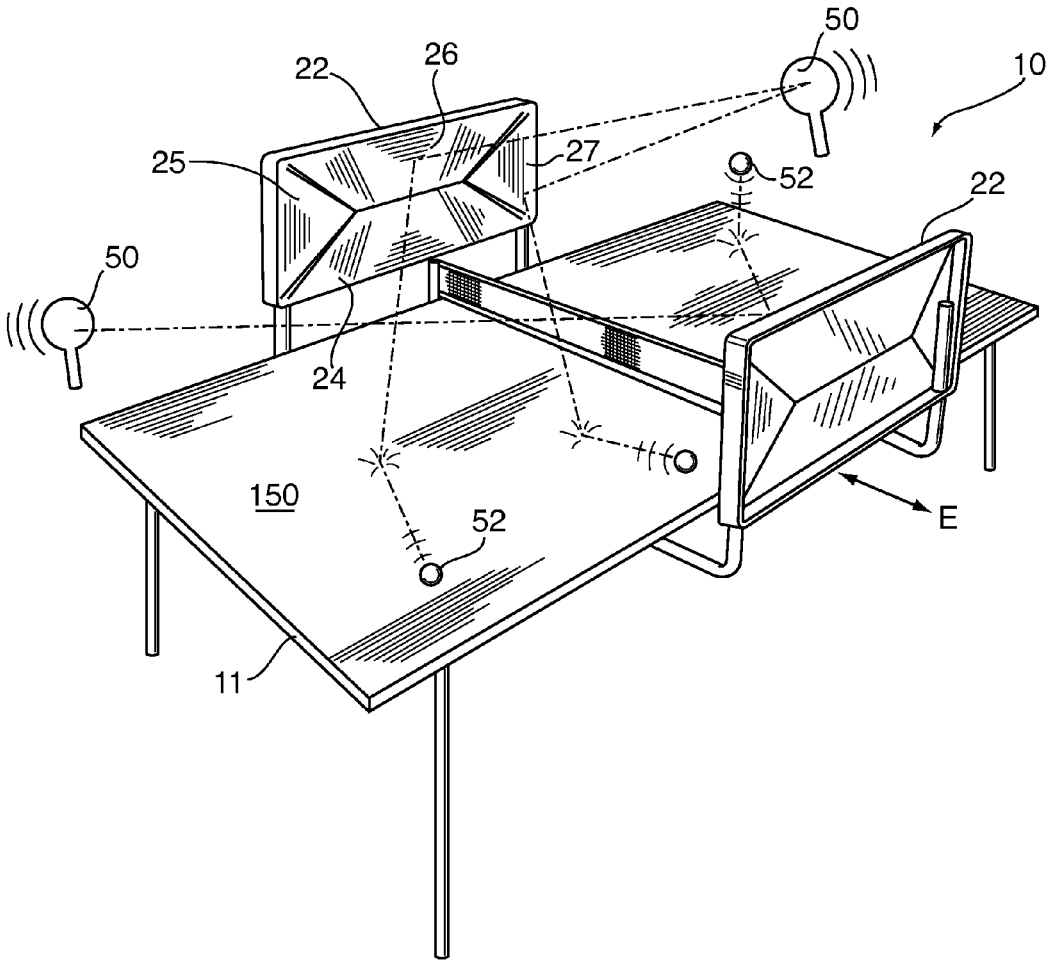
Fig.1 ( Prior Art )
FIG. 1 is a perspective view of a prior art table tennis apparatus, having a pair of vertically-upstanding rebounding panels with non adjustable inclination, disposed on opposite side edges of a table tennis table.

FIG. 1 shows a table tennis apparatus 10 of the prior art, having a table tennis table 11 with beveled panels 22 similar to the table tennis apparatus 10 shown and disclosed in U.S. Pat. No. 5,575,471.

Players using the table tennis apparatus 10 of FIG. 1 are intended, using table tennis paddles 50, to rebound a table tennis ball 52 of either of bevelled panels into an opposing players court. Notably, each of bevelled panels 22 having a similar plurality of variously-inclined surfaces 24, 25, 26, 27 which may each further be of materials of various densities and hardness to thereby provide correspondingly variable rebounding properties for table tennis ball 52 which is rebounded from an inclined surface 24, 25, 26, or 27 as shown.

Bevelled panels 22 remain substantially vertically fixed in position, although some lateral adjustment of bevelled panels in the horizontal plane, in the direction of arrow "E" in FIG. 1, is taught.

Disadvantageously, due to the combination of inclined surfaces on bevelled panels 22, the inability to adjust the height of the bevelled surfaces 24, 25, 26 and 27 on bevelled panels 22, and further the inability to adjust the inclination of the bevelled panels 22, use of the bevelled panel 22 in not intuitive for players and attempts by table tennis players to use the bevelled panels 22 as an extension of the table tennis playing surface 150 frequently results in the ball 52 not rebounding on the opposing players side of the table tennis table 11 (in which case the player attempting the rebounding off the bevelled panel loses a point or a serve), or alternatively due to the largely angle of rebounding, should the table tennis ball 52 land on the opposing players side, such player is often unable to return the ball 52, thereby losing a point. Both scenarios, however, immediately result in stoppage of play, which makes it all the harder for players to acquire experience in using the bevelled panels 22 as extensions of the table tennis table playing surface 150.

FIGS. 2-10

Accordingly, in order to overcome the disadvantages of the prior art, the present invention comprises a rebounding panel apparatus 100, various embodiments of which, including a table tennis table 11 incorporating and using such rebounding panel apparatus 100, are shown in FIGS. 2-10 inclusive.

Figure 2:
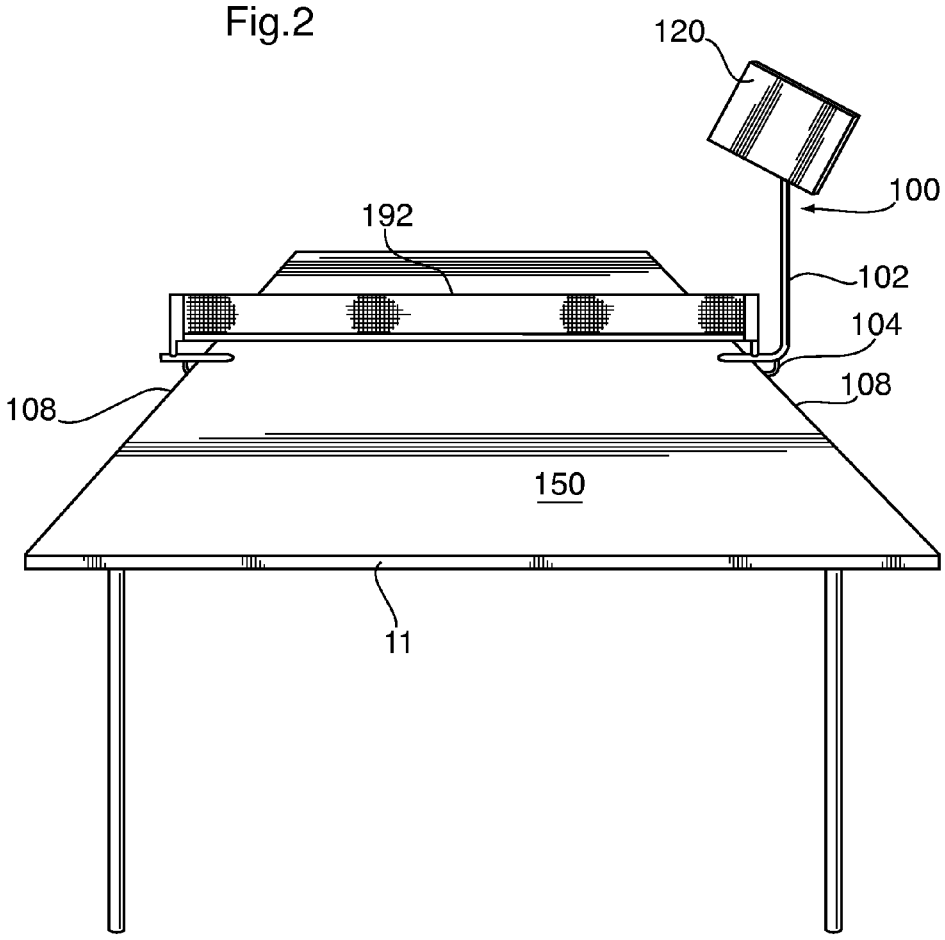
FIG. 2 is a perspective view of a table tennis table, having a rebounding panel apparatus of the present invention.

FIG. 2 shows one of such rebounding panel apparatus 100 affixed to a side edge 108 of a table tennis table 11.

Figure 3:
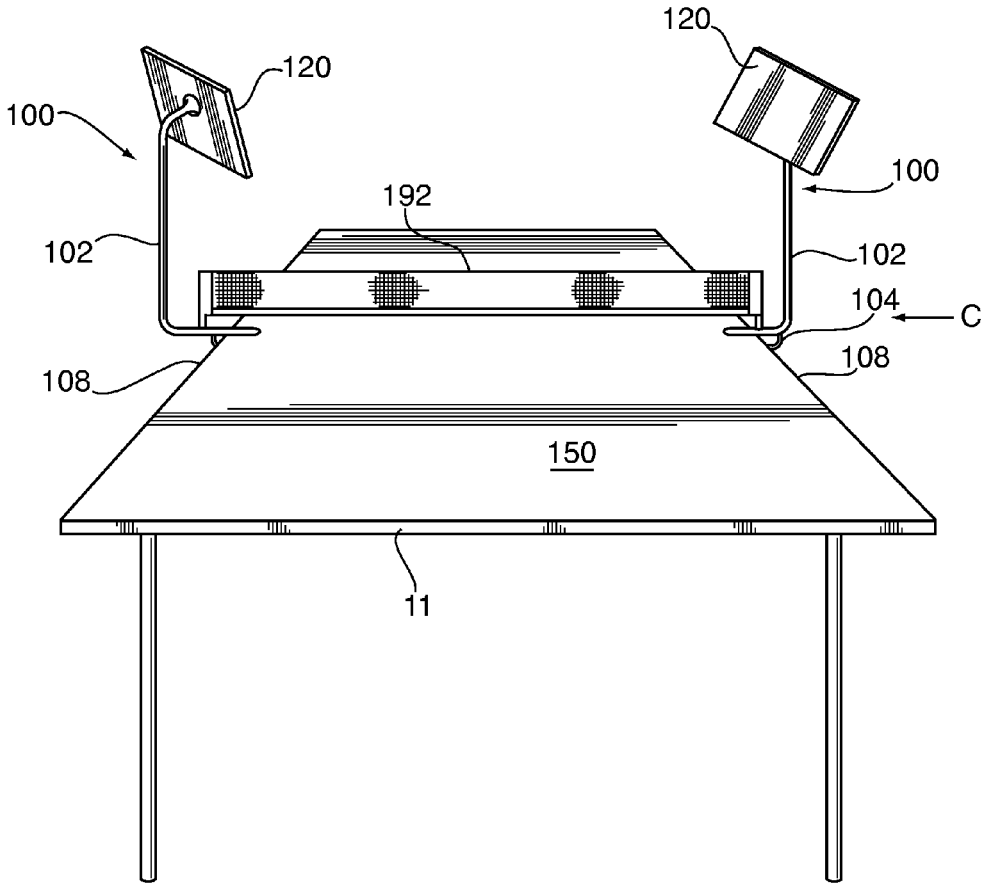
FIG. 3. is a perspective view of a table tennis table of a preferred embodiment, having a pair of rebounding panel apparatus and net support means.

FIG. 3 shows a preferred embodiment for a table tennis table 11 and for playing a table tennis game, having a pair of rebounding panel apparatus 100 affixed proximate a midpoint of such table tennis table 11, on mutually parallel and opposite side edges 108 of table tennis table 11.

Figure 4:
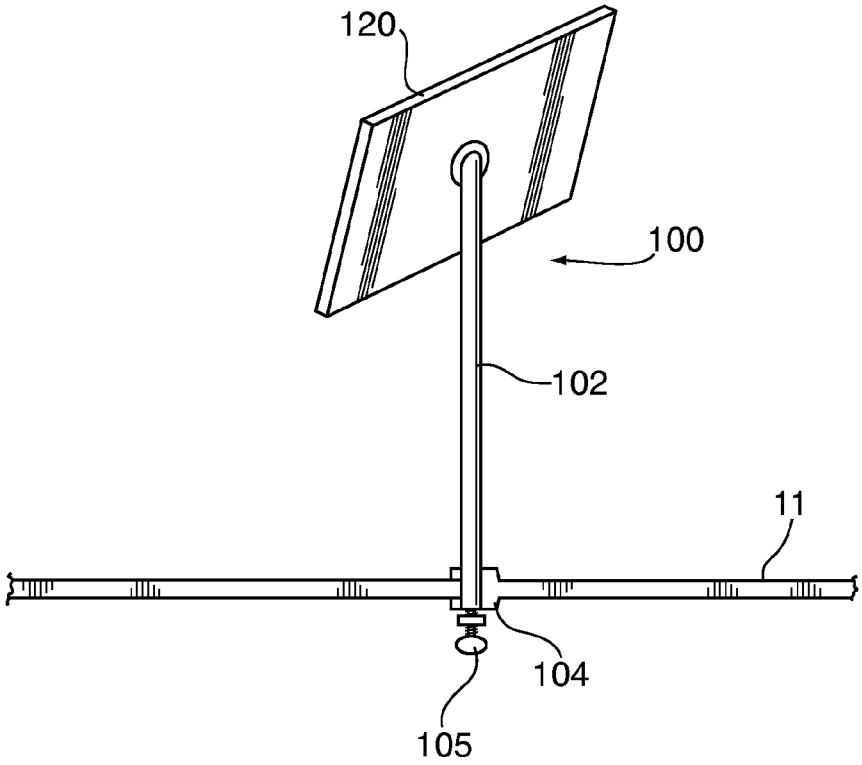
FIG. 4 is a view on Arrow 'C' of FIG. 3.
Figure 5:
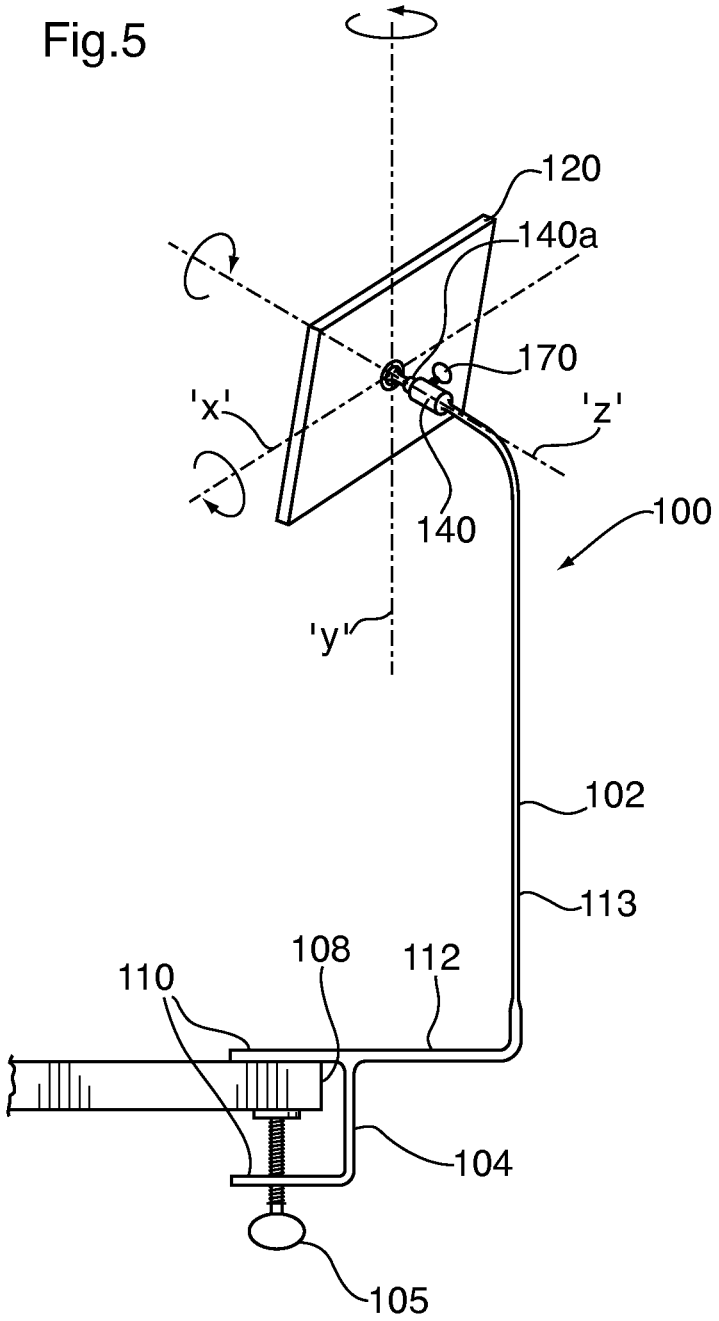
FIG. 5 is a partial end view of a table tennis table, showing installed thereon a first embodiment of the rebounding panel apparatus of the present invention (rebounding panel not shown, in order to better show support means and manner of installation)

As best seen in FIGS. 4 and 5, each rebounding panel apparatus 100 comprises a support member 102, having table attachment means 104 (typically comprising a threaded knob or wingnut 105) which may be threadably extended within bracket 110 so as to sandwich therebetween an edge 108 of table tennis table 11 to thereby affix the support member 102 to the table tennis table 11.

A substantially flat, planar rebounding panel 120 is provided, which is pivotably coupled to an upper distal end 130 of support member 102.

As best seen from FIG. 5, support member 102 comprises an 'L' ('⌋') shaped member 111, having a horizontal leg portion 112 and a vertical leg portion 113. Attachment means 140 is provided at upper distal end 130 of support member 102 to secure the rebounding panel member 120 to upper distal end 130 of support member 102.

Attachment means 140 may comprise any one of a number of pivotable attachment means, and in a preferred embodiment comprises a ball and socket 140*a*, which allows rotation of rebounding panel member 120 about each of three (3) mutually orthogonal axis, namely a pitch, yaw, and skew (roll) axis, designated respectively in FIG. 5 as axis "x", "y", and "z".

As best seen in FIGS. 2 & 3, support member 102, which is preferably a tubular or rod like member of relatively high strength, such as steel, is adapted to support rebounding panel member 120 above a plane in which playing surface 150 of table tennis table 11 lies.

As likewise best seen in FIGS. 2 & 3, the inclination of rebounding panel 120 may be adjusted to a desired angular inclination as best suited to a player's preferences by means of pivotable attachment means 140. Attachment means 140, preferably a ball and socket 140*a*, is further provided with a set screw 170 having a knurled or flattened end to allow manual tightening to ensure the individual rebounding panel member 120 remains in the desired angular inclination. Loosening of set screw 170 allows re-adjustment of the angular inclination and orientation of rebounding panel 120 to another desired angular inclination and orientation.

In such manner table tennis players may more readily develop their skills in using rebounding panel members 120 as an extension of table tennis table surface 150 by being able to "customize" the rebounding panel members 120 to an angle of inclination which best suits their manner of play and allows such player to more easily rebound table tennis balls 52 off such rebounding panel member 120 and onto the opposing player's side of the table tennis table 11.

Figure 6:
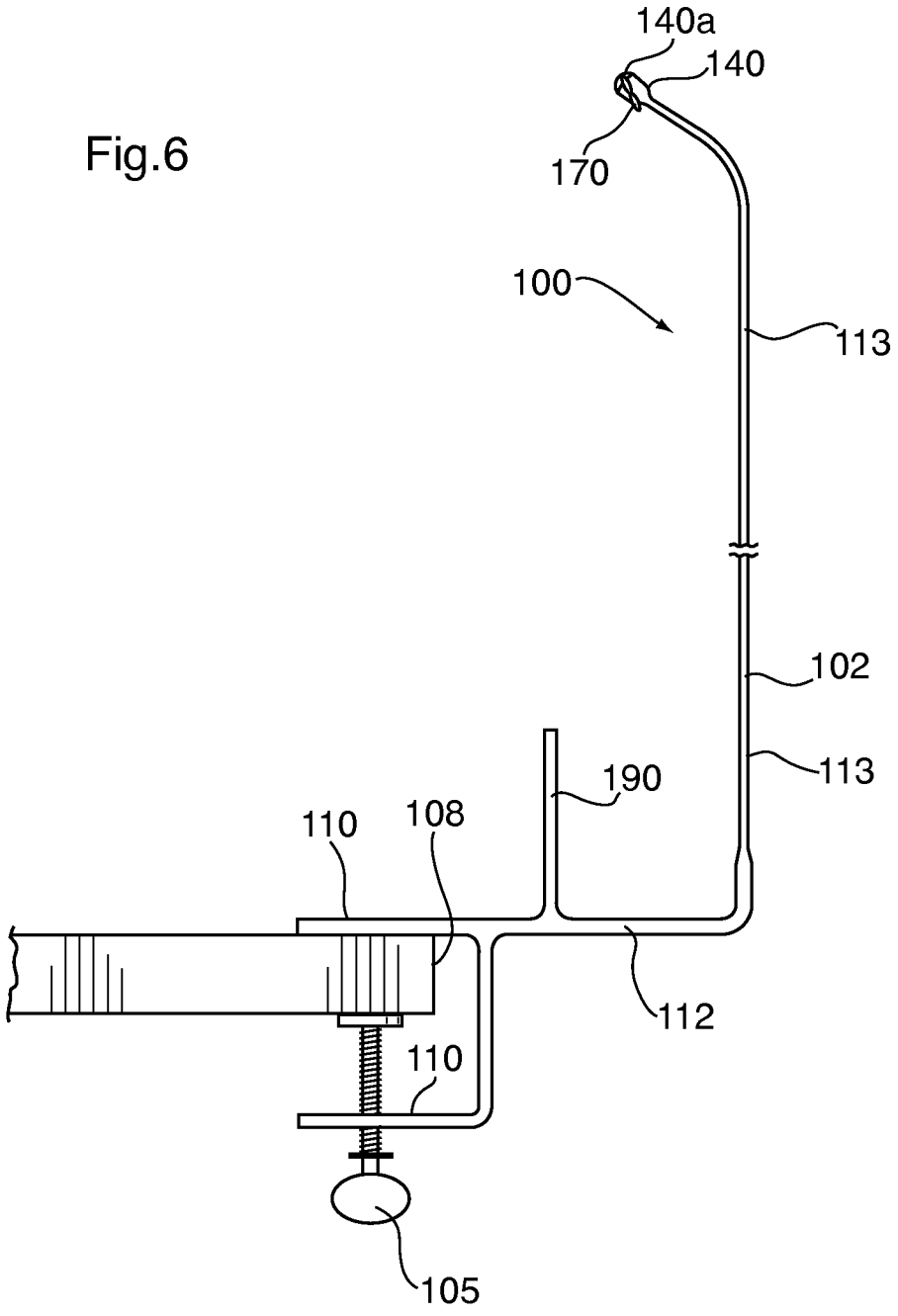
FIG. 6 is a view similar to that shown in FIG. 5, instead showing installed thereon a second alternative embodiment of the rebounding panel apparatus of the present invention, further having a table tennis net support means (again, the rebounding panel is intentionally omitted in order to better show the support structure and manner of installation)

FIG. 6 shows a further embodiment of the rebounding panel apparatus 100 of the present invention, wherein table tennis net support means 190 are provided to support and allow attachment of one end of a table tennis (table tennis) net 192 thereto, so as to allow positioning of the table tennis net 192 in a vertical position proximate a mid-section of the table tennis table 11, as shown in FIG. 1.

As shown in FIG. 6, table tennis net support means 190 comprise a vertically upwardly extending tubular or rod-like member.

In such manner, distal ends of table tennis net 192 may be secured to the table tennis net support means 190 of respective rebounding panel apparatus 100, as shown in FIG. 3, to allow a pair of rebounding panel apparatus 100 to also support and secure table tennis net 192.

Figure 7:
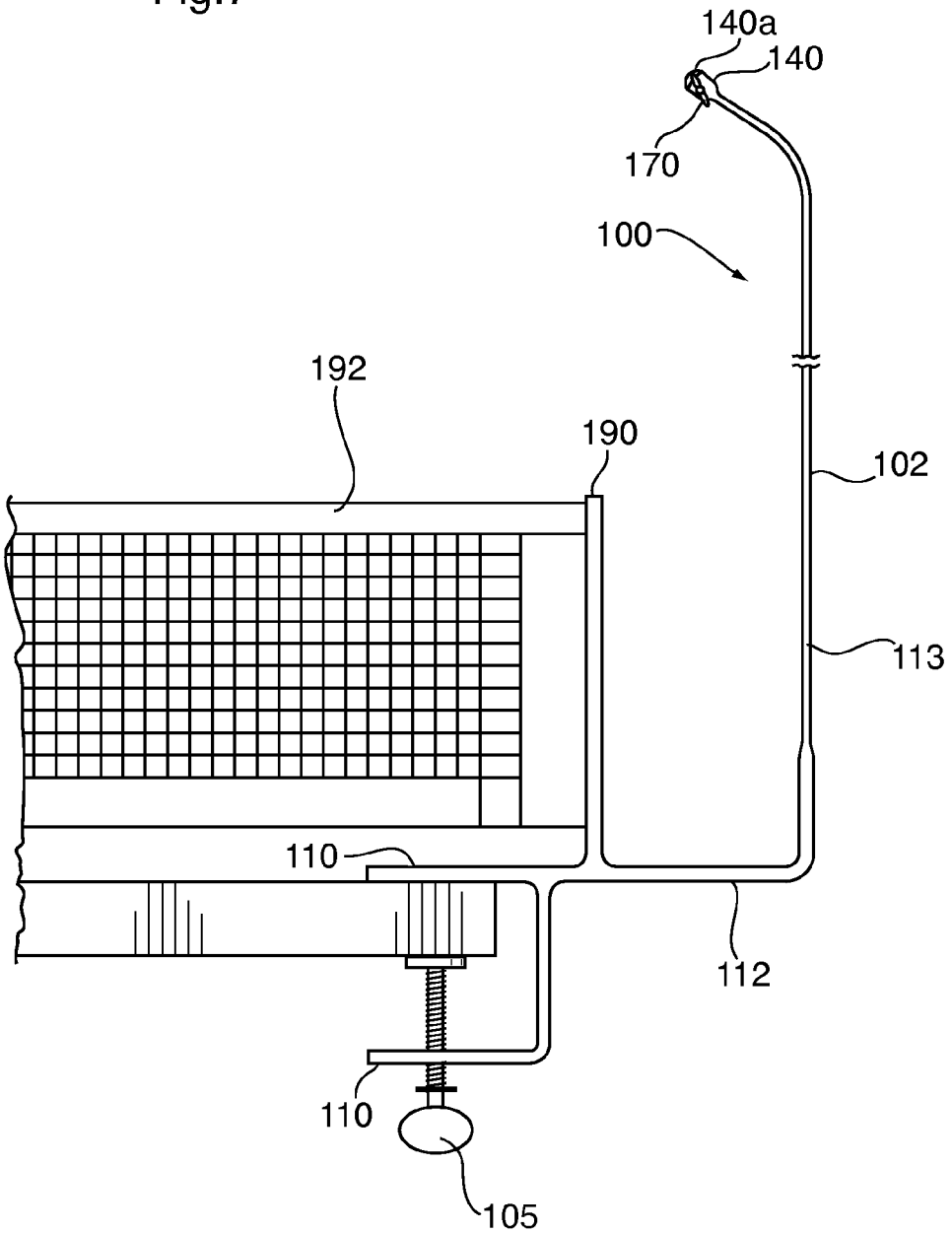
FIG. 7 is a view similar to that shown in FIG. 6, showing the manner of attachment of the table tennis net to the table tennis net support means (again, the rebounding panel is intentionally omitted in order to better show the support structure and manner of installation)

FIG. 7 shows a table tennis net 192 at one of its distal ends secured to and supported by table tennis net support means 190 of a rebounding panel apparatus 100 of the present invention.

Figure 8:
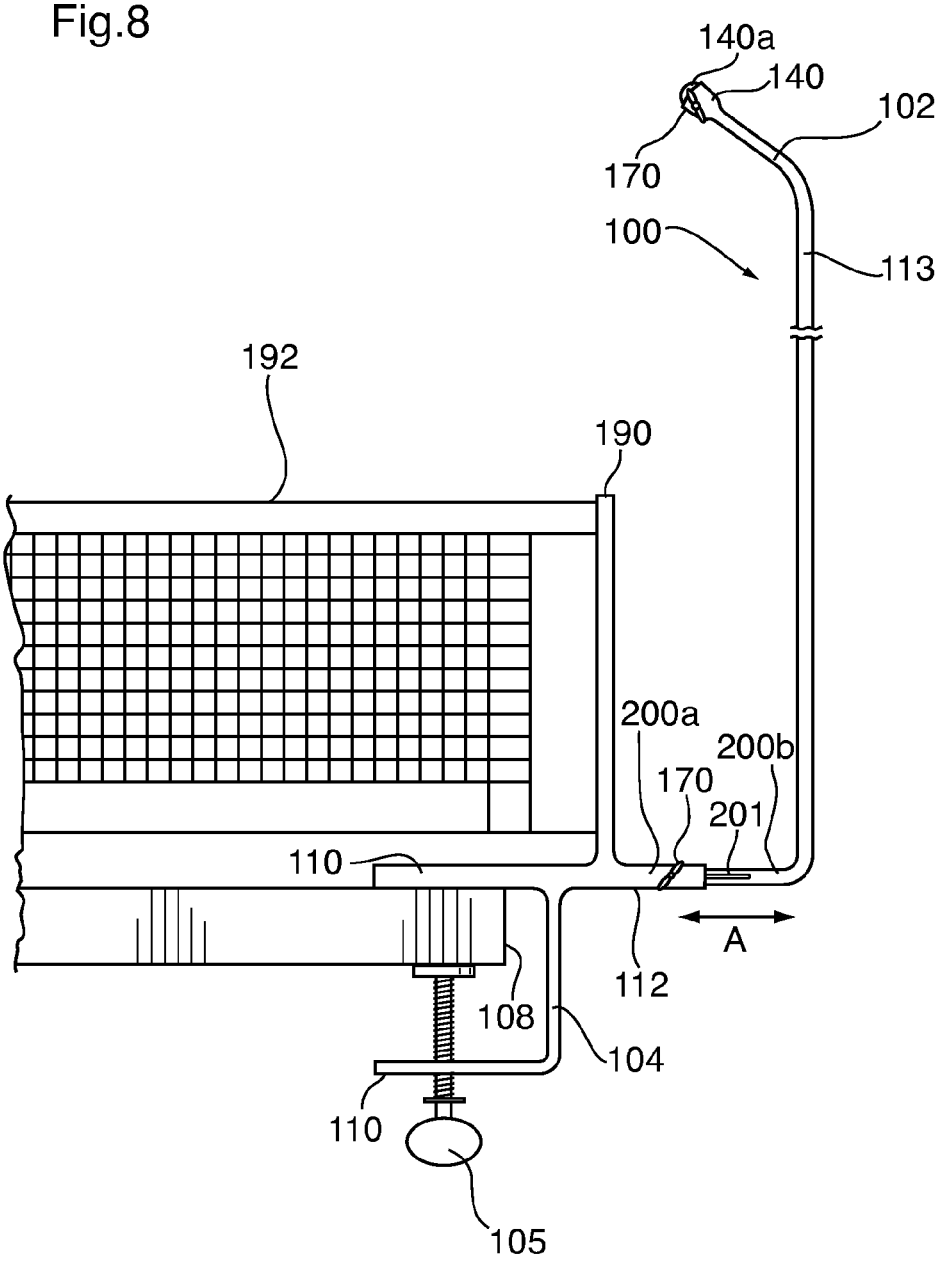
FIG. 8 is a view similar to that shown in FIG. 7, wherein the rebounding panel apparatus is further provided with lateral adjustment means (again, the rebounding panel is intentionally omitted in order to better show the support structure and manner of installation)

FIG. 8 shows a further embodiment of the rebounding panel apparatus 100 of the present invention, having lateral adjustment capability to permit variable lateral positioning, in the direction of arrow 'A', of a rebounding panel member 120 from a side edge 108 of a table tennis table 11. In such embodiment, the support means 102, in horizontal leg portion 112 thereof, comprises a pair of tubular members 200*a*, 200*b*, which may be slidably inserted one within the other, to allow telescoping extension and contraction of the length of horizontal leg portion 112. A horizontal slot 201 may be provided in one of the members 200*a*, 200*b* in which a guide member affixed to the other of members 200*a*, 200*b* travels (not shown) to ensure no relative rotation of one member 200*a* relative to the other member 200*b* which would otherwise result in the support means 102 failing to properly support and suspend rebounding panel member 120 above a plane in which playing surface 150 lies. A set screw 170 may further be provided to ensure the desired lateral adjustment remains, until other lateral adjustment is desired.

Figure 9:
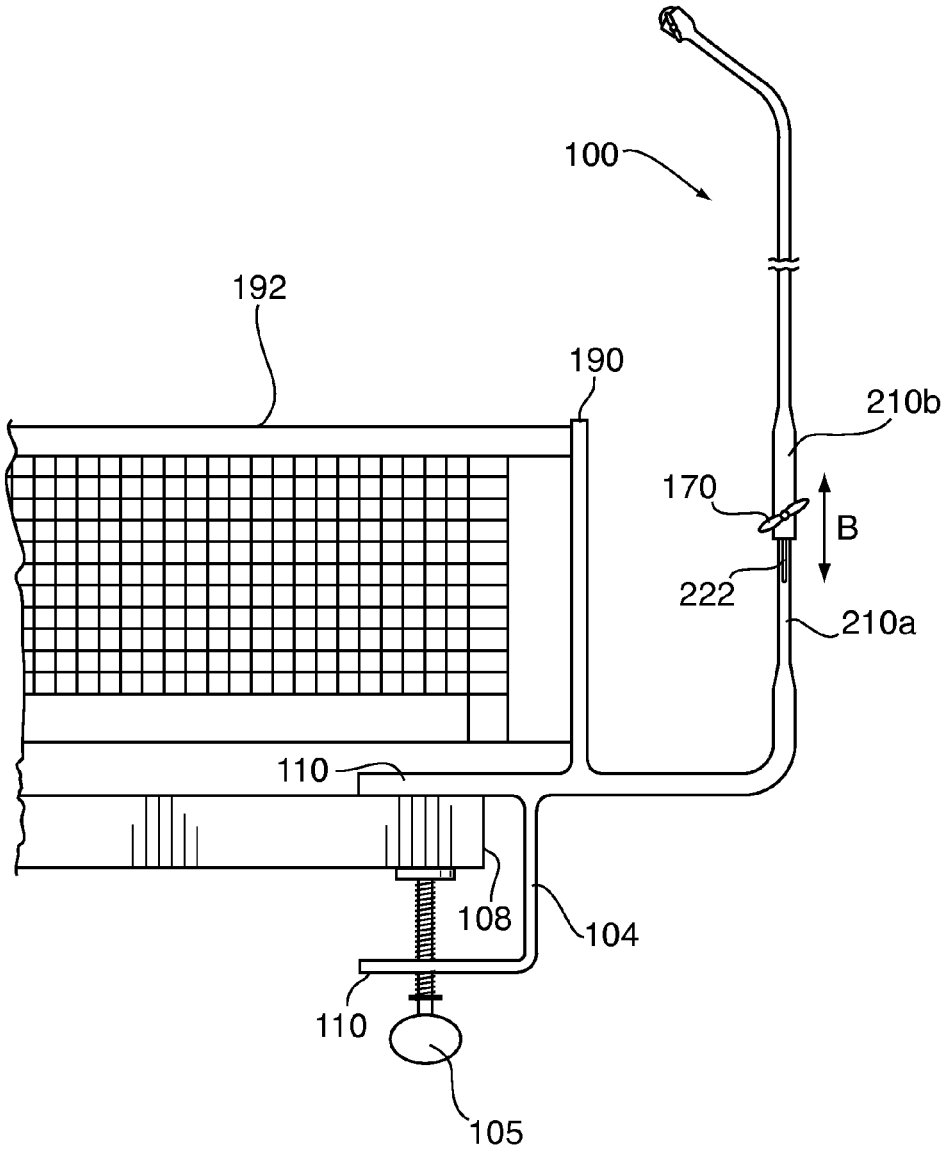
FIG. 9 is a view similar to that shown in FIG. 8, wherein the rebounding panel apparatus is alternatively provided with height adjustment means (again, the rebounding panel is intentionally omitted in order to better show the support structure and manner of installation)

FIG. 9 shows a further embodiment of the rebounding panel apparatus 100 of the present invention, having height adjustment capability to permit variable positioning in the direction of arrow 'B' with respect to the height of a rebounding panel member 120 above a plane of the horizontal playing surface 170 of table tennis table 11. In such embodiment, the support means 102, in vertical leg portion 113 thereof, comprises a pair of tubular members 210*a*, 210*b*, which may be slidably inserted one within the other, to allow telescoping extension and contraction of the length of vertical leg portion 113. A vertical slot 222 may be provided in one of the members 210*a*, 210*b* in which a guide member affixed to the other of members 210*a*, 210*b* travels (not shown) to ensure no relative rotation of one member 210*a* relative to the other member 210*b* which would otherwise result in the support means 102 failing to properly support and suspend rebounding panel member 120 above a plane in which playing surface 150 lies. A set screw 170 may similarly be provided to ensure the desired height adjustment remains, until other lateral adjustment is desired.

Figure 10:
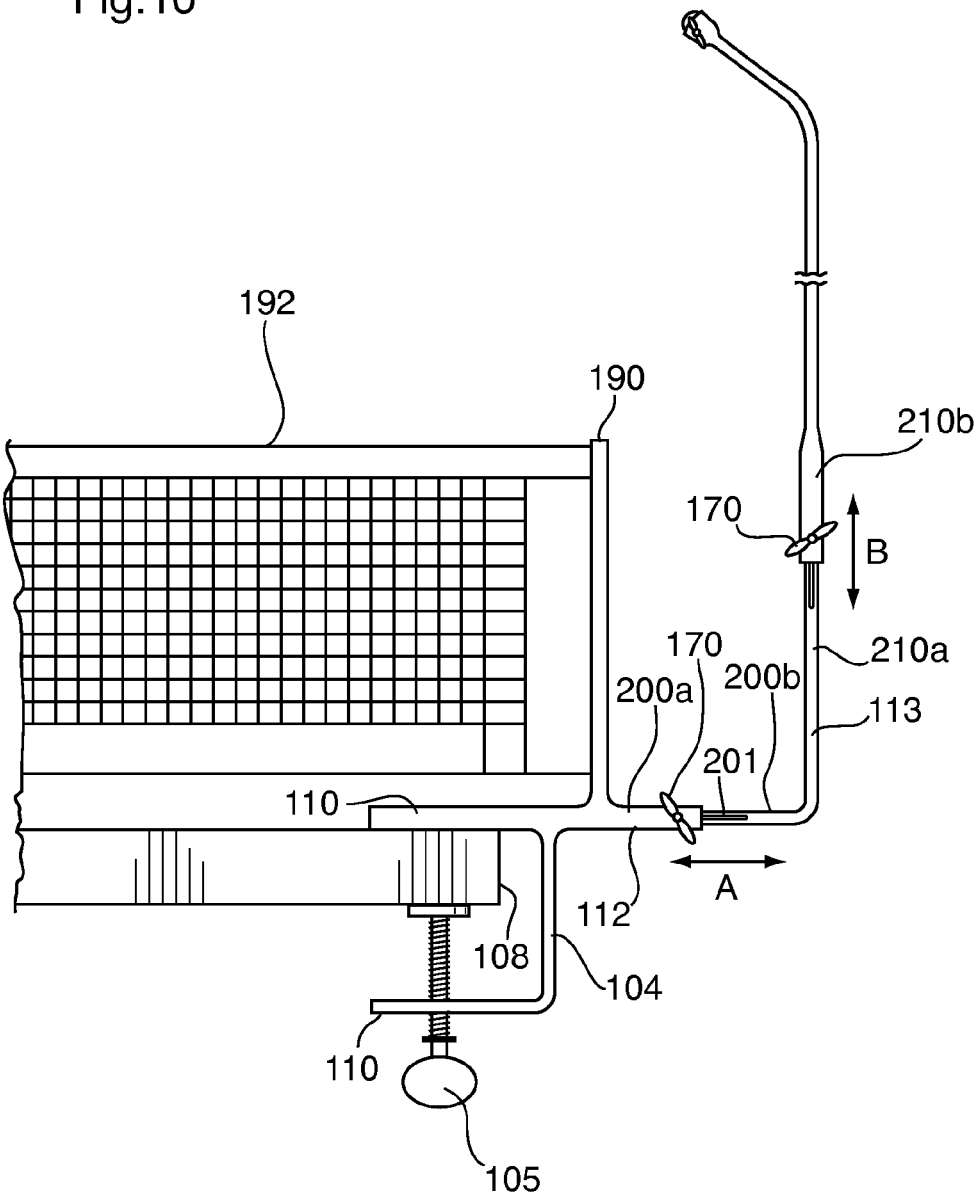
FIG. 10 is a view similar to that shown in FIG. 7, wherein the rebounding panel apparatus is further provided with both lateral adjustment means and height adjustment means (again, the rebounding panel is intentionally omitted in order to better show the support structure and manner of installation)

FIG. 10 shows a further embodiment of the invention, wherein the support member provides and combines both the lateral adjustment feature as shown in FIG. 8, as well as the vertical height adjustment feature, as shown in FIG. 9.

FIGS. 11-14

Figure 11:
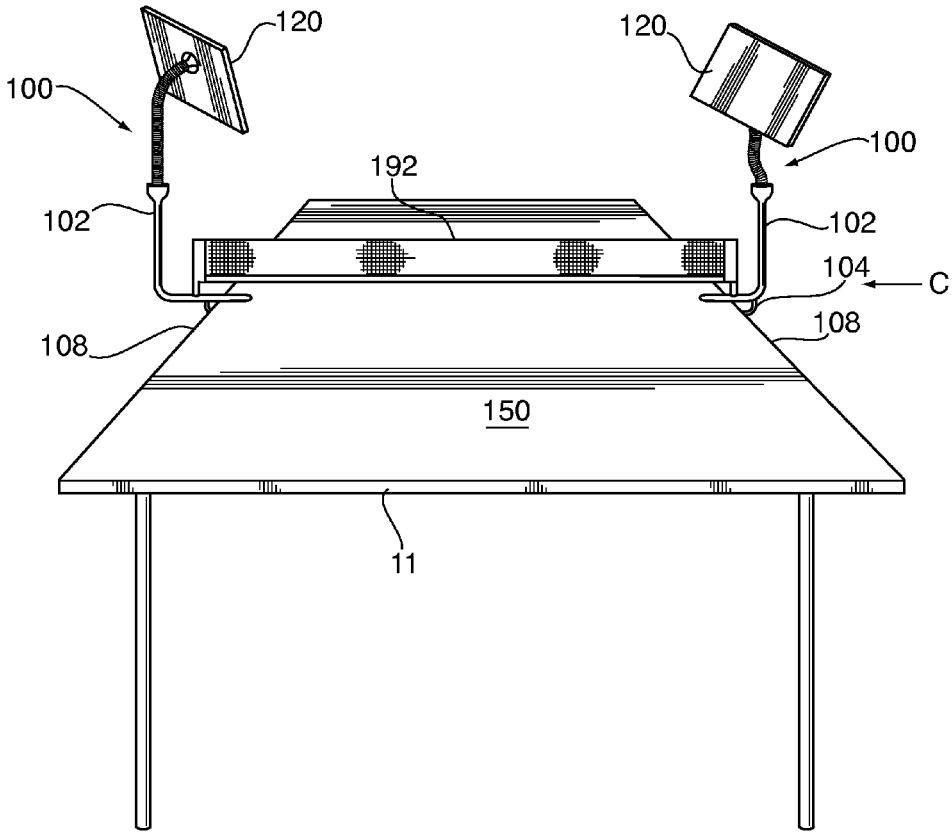
FIG. 11 is a perspective view of an alternative embodiment of the rebounding apparatus of the present invention, shown installed on a table tennis table, wherein the support member of the rebounding apparatus comprises a gooseneck resiliently-flexible member to allow variable angular positioning of the rebounding panel.
Figure 12:
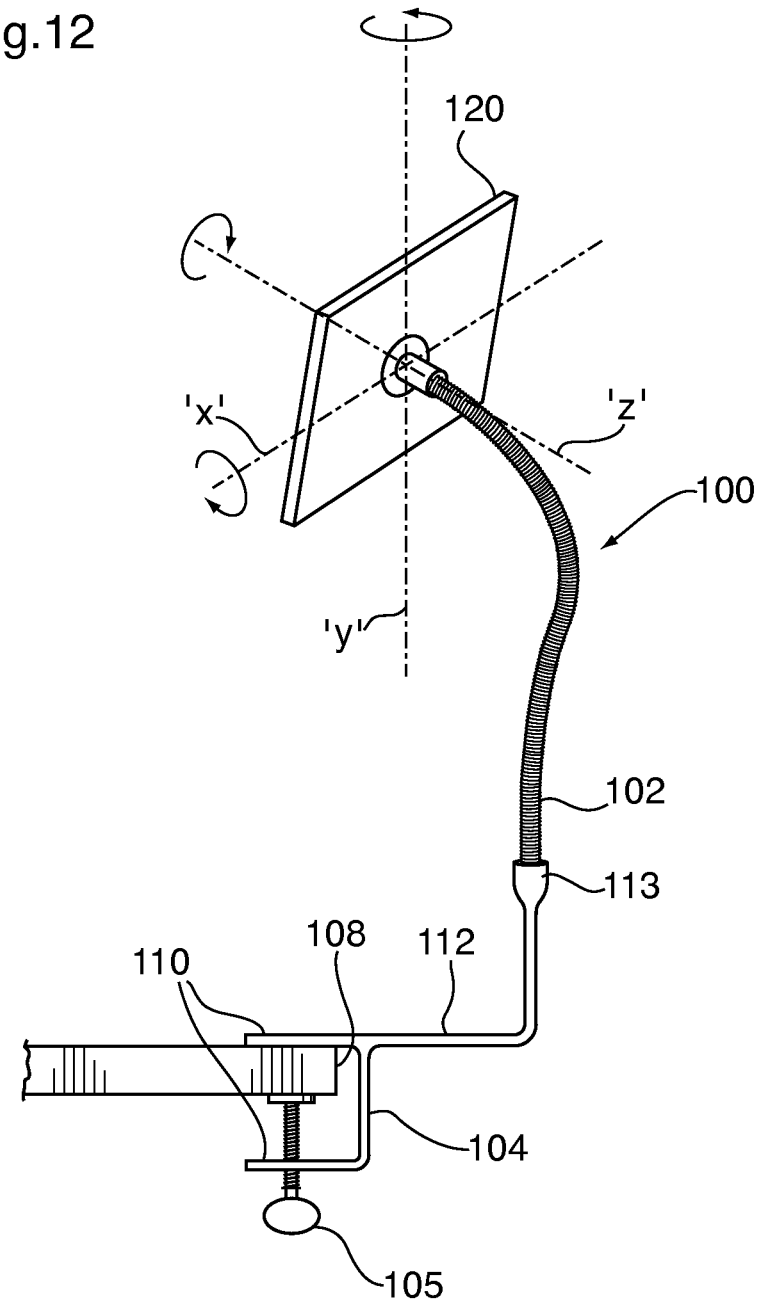
FIG. 12 is a detailed view of the rebounding apparatus of the present invention shown in FIG. 11.

FIG. 11 shows a perspective view of an alternative embodiment of the rebounding apparatus 100 of the present invention, shown installed on a table tennis table 11 wherein the support member 102 of the rebounding apparatus 100 comprises a gooseneck resiliently-flexible member 103 to allow variable angular positioning of the rebounding panel 120. Such gooseneck resiliently-flexible member 103 may be comprised of metallic flexible helically wound cabling as commonly used on gooseneck lamps or the like, and as commonly available at large hardware supply stores. As shown in FIG. 11 and as better shown in FIG. 12, the resiliently flexible gooseneck member 103 pivotably couples the rebounding panel member 120 to the support member 102, and allows for flexible orientation of the plane in which rebounding panel lies, about each of respective 'x', 'y', and 'z' axis.

Figure 13:
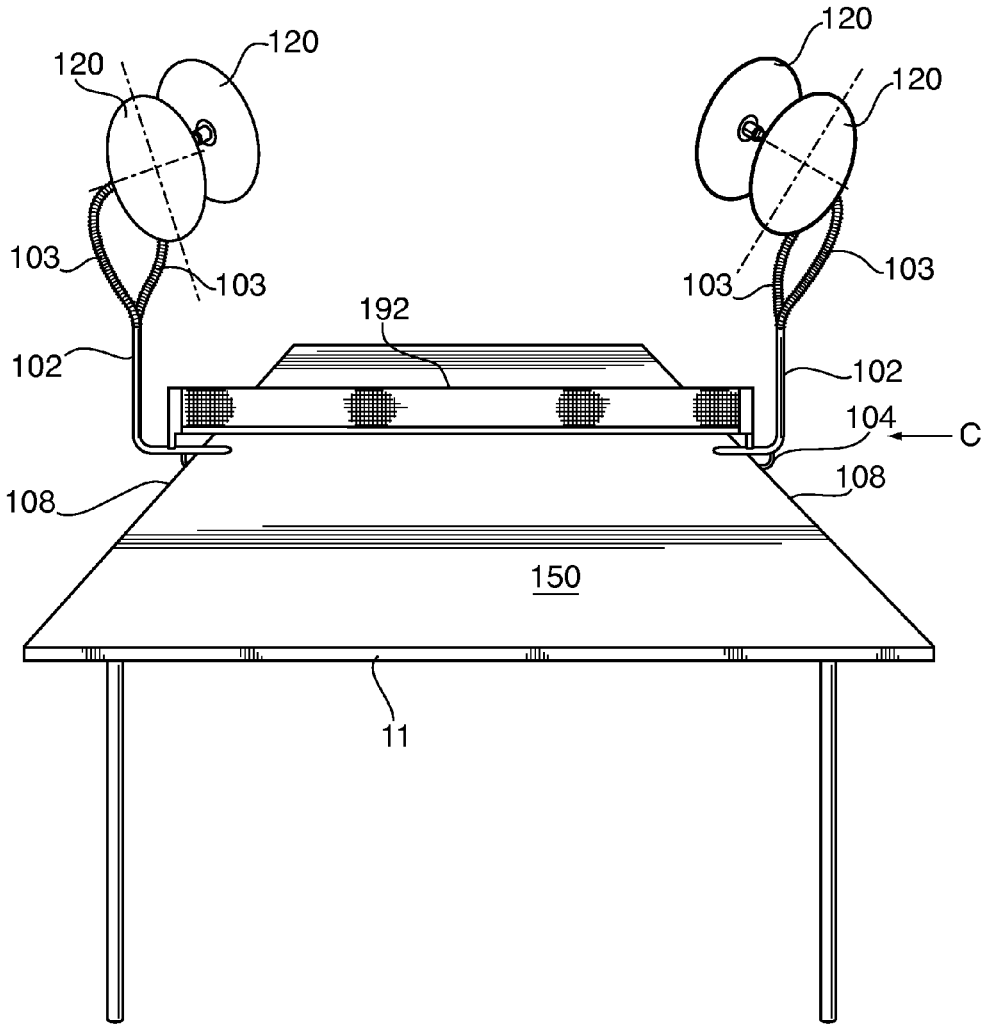
FIG. 13 is a perspective view of a further alternative embodiment of the rebounding apparatus of the present invention, shown installed on a table tennis table.
Figure 14:
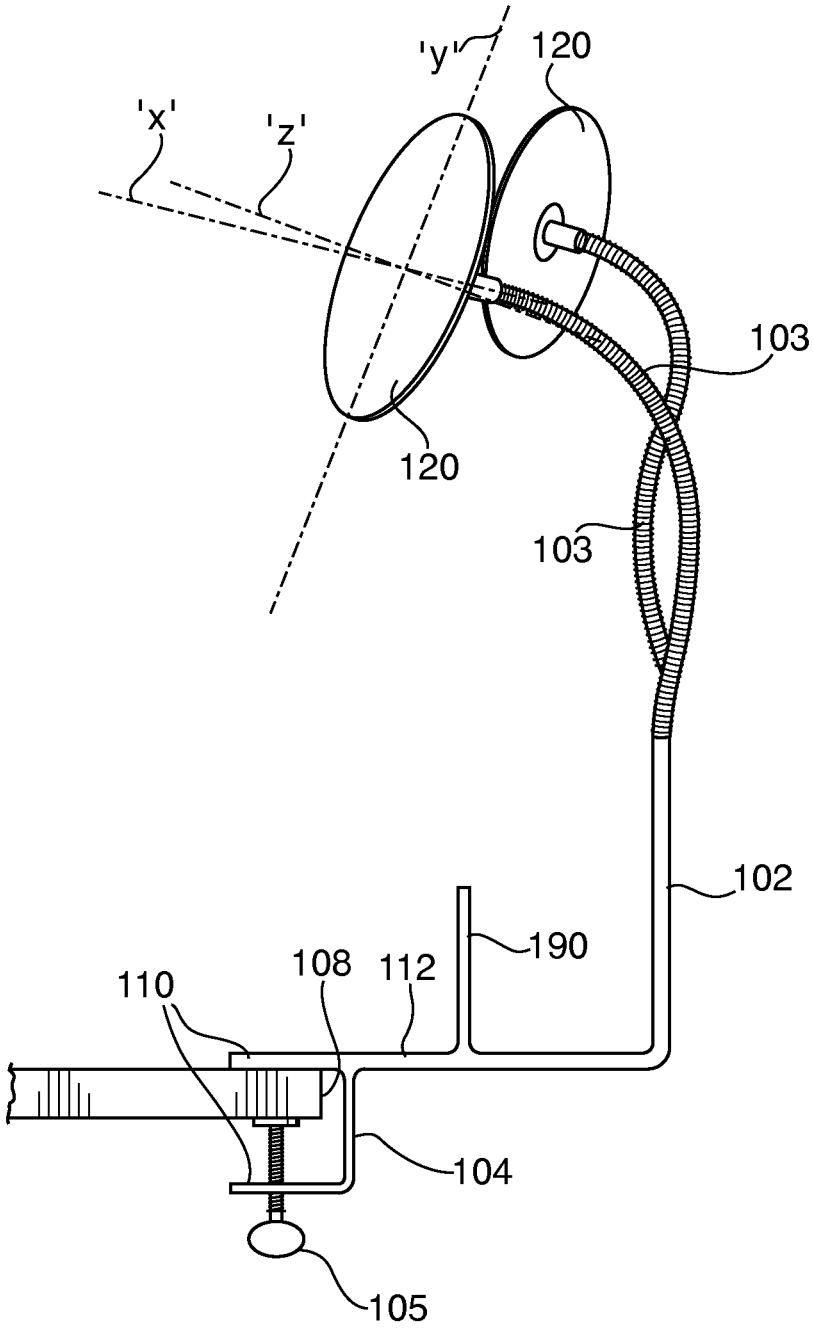
FIG. 14 is a detailed view of the rebounding apparatus of the present invention shown in FIG. 13.

FIG. 13 shows a perspective view of a further alternative embodiment of the rebounding apparatus 100 of the present invention, shown installed on a table tennis table 11, wherein each rebounding apparatus 100 comprises a pair of resiliently flexible gooseneck members 103 respectively pivotably coupling the rebounding panel members 120 to the respective support members 102, so as to provide each rebounding apparatus 100 with a pair of rebounding panel members 120. As best shown in FIG. 14, each rebounding panel member 120 is, via the resiliently resiliently-flexible gooseneck member 103, variably adjustable about each of respective axis 'x', 'y', and 'z' with respect to its angular orientation. Such allows each table tennis player to adjust the angular orientation of each panel to suit his or her playing preferences.

FIG. 15

Figure 15:
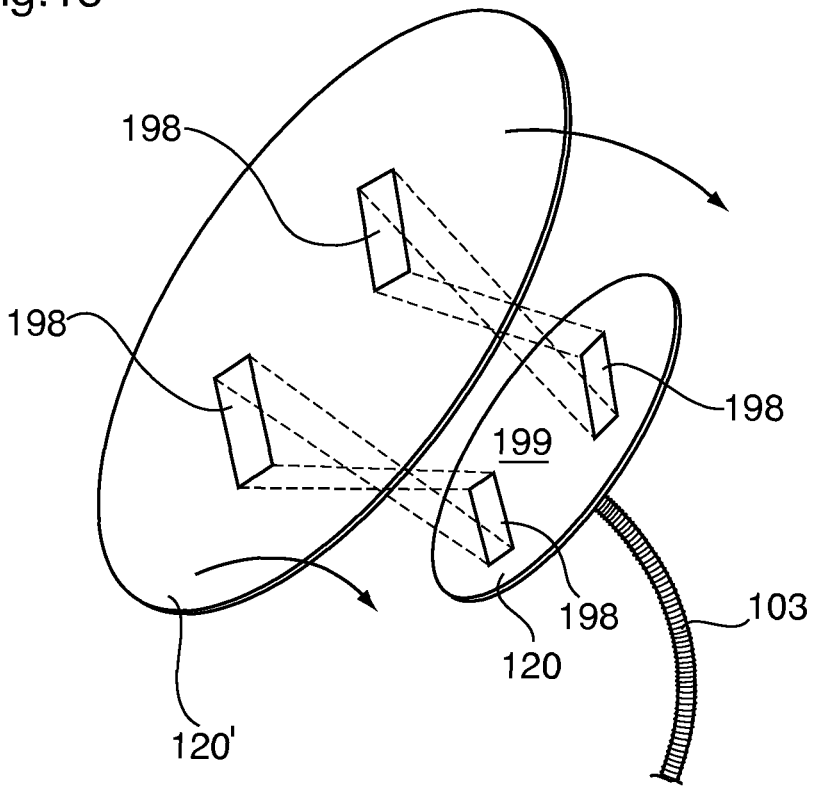
FIG. 15 depicts an embodiment of the invention, wherein the rebounding surface has Velcro™ fasteners, to permit attachment of variable-area additional rebounding surfaces from small-area rebounding surfaces to large-area rebounding surfaces.

FIG. 15 shows a further embodiment of the present invention, wherein the rebounding panels 120 may have adhesively applied to the planar surface 199 thereof hook or loop type fastener strips 198, to allow detachably securing a larger area rebounding panel 120', which has corresponding loop or hook type fasteners. Such embodiment players to increase, in various sizes, the size of the rebounding panel 120 by detachably securing a larger rebounding panel 120' if desired.

As shown in FIG. 15, a larger-area rebounding panel member 120' may be detachably secured to another smaller-area rebounding panel member 120, in order to increase the planar rebounding surface 199 thereof, if desired.

The foregoing description of the disclosed embodiments is provided to enable any person skilled in the art to make or use the present invention. Specifically, various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more".

Moreover, no element of any of the claims appended to this application is to be construed under the provisions of 35 USC §112, sixth paragraph, unless the claim element is expressly recited using the exact phrase "means for" or "step for".

For a complete definition of the invention and its intended scope, reference is to be made to the summary of the invention and the appended claims read together with and considered with the disclosure and drawings herein.

I claim:

1. A rebounding panel apparatus for adding a further playable surface for a table tennis table, comprising:

(i) a support member, having table attachment means to permit attachment of said support member to a side edge of a table tennis table proximate a midpoint of said table;

(ii) a rebounding panel member; and (iii) coupling means on said support member for coupling said rebounding panel member to said support member;

wherein said support member when attached to said table is adapted to support said rebounding panel member at a location spaced from a surface area of said table and thereby provide an open area between a surface of said rebounding panel member and said surface area of said table; and wherein said coupling means is adapted to permit adjustable inclination of said rebounding panel member in at least two degrees of freedom, namely adjustable about two or more of a pitch, yaw, and skew axis.

2. A rebounding panel apparatus as claimed in claim 1, wherein:

said coupling means is adapted to permit adjustable inclination of said rebounding panel member about each of said pitch, yaw, and skew axes.

3. A rebounding panel apparatus as claimed in claim 2 wherein said coupling means is a pivotable coupling means which comprises a ball and socket.

4. A rebounding panel apparatus as claimed in claim 1 wherein said coupling means comprises a goose-neck resiliently-flexible member.

5. A rebounding panel apparatus as claimed in claim 1 further comprising height adjustment means on said support means for permitting adjustment of an average height of said rebounding panel member above a plane in which said table lies.

6. A rebounding panel apparatus as claimed in claim 1, wherein said support member further comprises lateral adjustment means to permit variable lateral positioning of said rebounding panel member from a side edge of said table.

7. A rebounding panel apparatus as claimed in claim 1 wherein said support member further comprises table tennis net support means to support and suspend one end of a table tennis net so as to allow positioning of said table tennis net in a vertical position proximate a mid-section of said table tennis table.

8. A rebounding panel apparatus as claimed in claim 1 wherein an entirety of a rebounding surface of said rebounding panel member is substantial planar.

9. A rebounding panel apparatus as claimed in claim 1, wherein said rebounding surface has a pair of hook or loop type fasteners adhesively applied thereto, adapted to secure planar surfaces of variable areas thereto.

10. A rebounding panel apparatus for adding a further playable surface for a table tennis table, comprising:

(i) a support member, comprising an 'L'-shaped member having a horizontal leg portion and a vertical leg portion, having at an end of said horizontal leg portion farthest from of said vertical leg portion attachment means to permit fixation of said 'L'-shaped member to a side edge of a table tennis table proximate a midpoint of said table;

(ii) a rebounding panel member; and (iii) coupling means for coupling said rebounding panel to said vertical leg portion;

wherein said support member when attached to said table is adapted to support said rebounding panel member at a location spaced from a surface area of said table and above a plane in which said table lies and thereby provide an open area between a surface of said rebounding panel member and said surface area of said table; and wherein said coupling means is adapted to permit adjustable inclination of said rebounding panel member in at least two degrees of freedom, namely adjustable about two or more of a pitch, yaw, and skew axis.

11. A rebounding panel apparatus as claimed in claim 10, wherein:

said means is adapted to permit adjustable inclination of said rebounding panel member about each of said pitch, yaw, and skew axes.

12. A rebounding panel apparatus as claimed in claim 10 wherein said coupling means is situated at an upper extremity of said vertical leg portion of said 'L'-shaped member, and said vertical leg portion is slidably extendable to permit sliding extension or contraction of said vertical leg so as to permit slidable adjustment of an average height of said rebounding panel above said plane in which said table lies.

13. A rebounding panel apparatus as claimed in claim 10 wherein said coupling means comprises a goose-neck flexible coiled metallic member.

14. A rebounding panel apparatus as claimed in claim 10 wherein said coupling means is situated at an upper extremity of said vertical leg portion of said 'L'-shaped member, and wherein said horizontal leg portion of said 'L'-shaped member is slidably extendable or retractable so as to permit extension or contraction of said horizontal leg portion so as to permit variable lateral positioning of said rebounding panel from a side edge of said table.

15. A rebounding panel apparatus as claimed in claim 10 wherein said support member further comprises table tennis net support means to support and suspend one end of a table tennis net so as to allow positioning of said table tennis net in a vertical position proximate a mid-section of said table tennis table.

16. A rebounding panel apparatus as claimed in claim 10 wherein substantially an entirety of a rebounding surface of said rebounding panel member is planar.

17. A rebounding panel apparatus as claimed in claim 10 wherein said rebounding surface has a pair of hook or loop type fasteners adhesively applied thereto, adapted to secure planar surfaces of variable areas thereto.

18. A rebounding panel apparatus as claimed in claim 11 wherein said rebounding surface has a pair of hook or loop type fasteners adhesively applied thereto, adapted to secure planar surfaces of variable areas thereto.

19. A rebounding panel apparatus as claimed in claim 11, wherein said coupling means comprises a goose-neck resiliently-flexible member.

20. A table tennis apparatus for playing table tennis, comprising:

(i) a table having a substantially planar playing surface, further having support means to support said playing surface in a horizontal position;

(ii) a pair of rebounding panel apparatus for adding a further playable surface for a table tennis table, each of said rebounding panel apparatus comprising:

(a) a support member, having table attachment means to permit attachment of said support member to a side edge of a table tennis table proximate a midpoint of said table;

(b) a rebounding panel member; and (c) coupling means on said support member for coupling said rebounding panel member to said support member;

wherein said support member when attached to said table is adapted to support said rebounding panel member at a location spaced from a surface area of said table and thereby provide an open area between a surface of said rebounding panel member and said surface area of said table; and wherein said coupling means is adapted to permit adjustable inclination of said rebounding panel member in at least two degrees of freedom, namely adjustable about two or more of a pitch, yaw, and skew axis.

21. A table tennis apparatus for playing table tennis as claimed in claim 20, wherein:

said support member of each of said pair of rebounding panel apparatus further comprises table tennis net support means to support and suspend respectively one end of a table tennis net so as to allow positioning of said table tennis net in a vertical position proximate a mid-section of said table and intermediate said pair of rebounding panel apparatus; and said pair of rebounding panel apparatus each position able on respectively opposite side edges of said table and proximate a midpoint thereof so as to further suspend said table tennis net at a location midpoint of said table.

22. A table tennis apparatus as claimed in claim 20 wherein said rebounding surface has a pair of hook or loop type fasteners adhesively applied thereto, adapted to secure planer surfaces of variable areas thereto.

23. A table tennis apparatus as claimed in claim 20 wherein said coupling means permits adjustable inclination of said rebounding panel member about each of said pitch, yaw, and skew axes.

24. A table tennis apparatus as claimed in claim 20, wherein said coupling means comprises a goose-neck resiliently-flexible member.

* * * * *